United States Patent [19]

Schwartz

[11] Patent Number: 4,739,218

[45] Date of Patent: Apr. 19, 1988

[54] SHORT CATHODE RAY TUBE

[76] Inventor: Samuel A. Schwartz, P.O. Box 2066, Saratoga, Calif. 95070

[21] Appl. No.: 724,678

[22] Filed: Apr. 18, 1985

[51] Int. Cl.[4] ..... H01J 29/72

[52] U.S. Cl. ..... 313/433; 313/427; 313/432; 313/439; 315/3

[58] Field of Search ..... 313/421, 422, 423, 477 R, 313/432, 433, 439; 315/3

[56] References Cited

U.S. PATENT DOCUMENTS

| | | | |
|---|---|---|---|
| 2,156,915 | 5/1939 | Knoll | 313/423 |
| 2,158,314 | 5/1939 | Korshenewsky | 313/420 |
| 2,163,787 | 6/1939 | Henneberg et al. | 313/423 |
| 2,164,555 | 7/1939 | Truell | 313/426 |
| 2,211,613 | 8/1940 | Bowie | 313/477 |
| 2,222,955 | 11/1940 | Orthuber et al. | 313/423 |
| 2,332,876 | 3/1939 | Uhlmann | 313/423 |
| 2,436,393 | 2/1948 | Maggio | 313/432 |
| 2,464,562 | 3/1949 | Diemer | 313/439 |
| 2,728,025 | 12/1955 | Weimer | 313/423 |
| 2,728,027 | 12/1955 | Scull | 313/426 |
| 2,915,673 | 12/1959 | Atti | 315/3 |
| 3,080,500 | 3/1963 | Preston | 313/423 |
| 3,412,282 | 11/1968 | De Lord et al. | 313/423 |
| 3,979,631 | 9/1976 | van der Ven | 313/450 |

FOREIGN PATENT DOCUMENTS

| | | | |
|---|---|---|---|
| 1052647 | 1/1954 | France . | |
| 1064959 | 5/1954 | France . | |
| 57-38544 | 3/1982 | Japan | 313/421 |
| 440106 | 12/1935 | United Kingdom . | |
| 1202563 | 2/1971 | United Kingdom . | |

OTHER PUBLICATIONS

Proceedings of the I.R.E., Oct. 1951, Weimer, P. and Rynn, N., "A 45-Degree Reflection-Type Color Kinescope".

Moss, H., *Narrow Angle Electron Guns and Cathode Ray Tubes*, Academic Press, N.Y., 1968, pp. 110–117.

*Proceedings of the SID*, vol. 28, No. 1, 1987, pp. 3–8, Schwartz, S. A., "Short Cathode Ray Tube".

*Primary Examiner*—David K. Moore

*Assistant Examiner*—Theodore C. Salindong

[57] ABSTRACT

A short cathode ray tube (CRT) is formed wherein the axes of deflection in the X and Y directions are separated, and by bending the electron beam path in a region between the separated axes. The deflections and beam bending may be accomplished magnetically or electrostatically. The CRT may use a single electron gun or a multiple gun assembly.

8 Claims, 4 Drawing Sheets

SHORT CATHODE RAY TUBE

DESCRIPTION

Technical Field

This invention relates to a cathode ray tube (CRT) and in particular to a CRT which is compact and has a short depth.

Background of the Invention

After decades of long and dependable service, the cathode ray tube is still the dominant display device in television, computer, and information presentation equipments. Although this favorable position has been challenged in recent years by alternative solid state, vacuum, and gaseous display devices, none has achieved the low cost, long life, display quality, ease of manufacture, flexibility of use, readability, ease of addressability, simplicity of support circuitry, large display size, high resolution, and the ability to reproduce color as is readily achievable with the cathode ray tube.

With all its many advantages, the conventional cathode ray tube has always had one serious objectionable characteristic and that is its physical length. This single geometrical dimension has resulted in physical enclosures, for the tubes, that have had excessive lengths, as measured by the front to back dimension. This length dimension also is designated as the depth of the tube. As an example, the television receiver has long been the target of a continuing engineering effort toward the goal of reducing the length or depth of the enclosure. The only solution available to date utilizes deceptive styling to achieve this end. The result is an enclosure exhibiting a short frontal surrounding area with a less visible funnel-like cover containing the protruding neck of the cathode ray tube. If that rear funnel-like cover could be eliminated, with nothing protruding behind the frontal portion of the enclosure, the television receiver would fit comfortably on a shelf or even be hung on the wall. The tube described, herein, allows this last feature to be achieved by providing a length that is approximately half that of the conventional tube.

Similarly, in the computer field there is a need for compact, low cost displays for the purpose of adding transportability to computing devices. Although liquid crystal, plasma, and electroluminescent devices are being used today for this purpose, they are deficient in many of the desirable features provided by cathode ray tubes. This application can be handled adequately by the invention described herein.

Flat cathode ray tubes have been experimental curiosities since the early 1950's and only recently have commercial versions become available. While flat tubes have an even shorter length than the subject short tube, they are limited in the size in which they can be constructed. Since the deflection area in the flat tube projects beyond the end of the display area, and the neck extends even further beyond the deflection area, the physical height or width becomes an unmanageable dimension. The maximum practical size for a flat tube is ten inches along the diagonal. This limitation does not exist for the short tube of this invention since the folded deflection area and the neck are accommodated behind the display area and, consequently, does not extend appreciably the height and width dimensions of the tube. In the larger tube sizes the neck is fully contained within the profile of the display area.

Summary of the Invention

An object of this invention is to provide a cathode ray tube, suitable for video display applications, that retains all of the desirable characteristics of the conventional cathode ray tube and yet exhibits a short physical length.

Another object is to provide these characteristics without imposing a penalty in the cost, complexity, and power comsumption of the associated circuitry and componentry.

In order to achieve the short length cathode ray tube of this invention, a finite separation between the two centers of deflection is provided. In addition, a bend is provided in the path of the electron beam between the separated centers of deflection.

In effect, the short length of the cathode ray tube is accomplished by three factors, namely.

(1) a bending of the beam path;

(2) secondary deflection along the horizontal axis; and (3) an increase in the vertical deflection angle.

The novel cathode ray tube of this invention may be constructed using only factor 1, or with factor 1 and any combination of factors 2 and 3.

Description of Drawings

The invention will be described with reference to the drawings in which.

Detailed Description of the Invention

Figure 1:
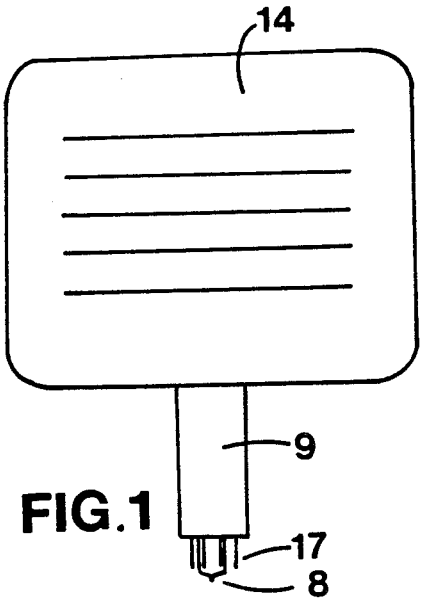
FIG. 1 is a front view of the short depth cathode ray tube of this invention, displaying a message.

The conventional display cathode ray tube employing, primarily, magnetic deflection for an X-Y presentation on its screen, has a common region in which both of the orthogonal deflection fields, typically horizontal and vertical, are produced.

It is possible, although unconventional, to construct a tube in which these two deflection field regions are separated. Once this is accomplished, the physical length of the tube is extended over the length of the conventional tube by the amount of the separation. Although a physically longer tube results, some interesting side effects become apparent. First, for a fixed display size, the deflection angle of the deflection region closest to the tube's gun is decreased as a direct function of the separation. Second, the beam paths in the region between the two deflection fields lie in a single plane. Third, the deflection angle of the deflection region closest to the screen may be selected independently of the angle of the other deflection region. The significance of the first effect may be illustrated, by way of an example, with reference to a television receiver wherein the maximum deflection angle is limited, primarily, by the horizontal deflection system. This is due to both the availability of deflection components and to a variety of distortions of the display resulting from wide deflection angles. By the expediency of reducing the deflection angle, the magnitude of the overall deflection problem is reduced. In addition, since the vertical deflection angle is no longer directly dependent on the horizontal deflection angle, the vertical deflection angle may be chosen independently and thus may be increased. This, in turn, reduces the dimension from the vertical deflection region to the screen, which tends to shorten the tube's length. Although length reduction from this factor is not large, it is important to the overall reduction as finally achieved in this invention.

The consequence of the second condition results in the significant and largest factor of length reduction and is made possible by the first condition. Since the deflected paths of the electron beam, between the two deflection regions, lie in a plane, a single dimensional right angle bend may be placed within that plane. The practicality of the reduction of the tube's length lies in the ease and simplicity in which this bend may be implemented. Although beam bending may be accomplished by eiher electrostatic or magnetic means there are good reasons to prefer to former.

In the prior art, various forms of beam benders or electronic prisms and mirrors have been used for other applications. The particular type of bender chosen for this tube has the advantages of no loss of beam current in passing through the bender, no defocussing of the beam, and curvature of the resultant trace on the fluorescent screen that is easily correctable. Maximum length reduction is achieved by placing the bend as close to the vertical deflection system as possible. The limitation to this spacing depends on how well the stray field from the vertical deflection coils may be reduced in the location of the bend. A small magnetic shield between the vertical coils and the bend mechanism is effective in producing the magnetic isolation required for close spacing.

A secondary length reduction method may be employed to enhance the tube's length. In essence, a double deflection is imparted to the beam along the horizontal deflection path. This is accomplished by providing an additional set of horizontal deflection coils within the vertical deflection assembly. With this arrangement, the beam is deflected horizontally, for the first time, immediately beyond the electron gun. Then, after passing through the bend mechanism, the beam is deflected a second time before reaching the screen. This results in a larger total deflection angle than that provided by the initial deflection field alone. From the standpoint of overall economy of the driving circuitry, both sets of horizontal deflection coils are driven from a common deflection circuit. Since both deflection angles are relatively small this imposes no electrical stress on available components. The second set of deflection coils represent a small increment in cost to the vertical deflection assembly.

Figure 2:
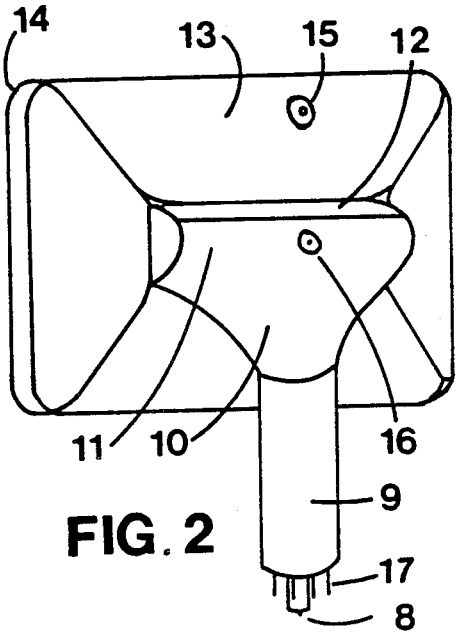
FIG. 2 is a side rear view of the envelope configuration of the short cathode ray tube.

With reference to FIGS. 1 and 2, a highly evacuated glass envelope of special predetermined shape consists of a neck 9, a first deflection section 10, a bend section 11, a second deflection section 12, a cone section 13, and a viewing faceplate 14. In addition, electrical connections are provided by a high voltage connector 15, a ground connector 16, and an electron gun connector 17, and vacuum tipoff 8 is centered within the connector 17.

Figure 3:
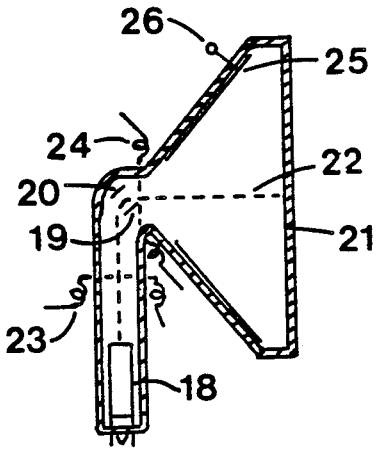
FIG. 3 is a cutaway side view of the tube, showing the electron beam path from the electron gun, through the bend and vertical deflection region, and finally terminating on the screen.

The elements internal to the envelope are shown in FIG. 3 and consist of the electron gun 18, an attractor plate 19, a reflector plate 20, a fluorescent screen 21, and a high voltage electrode 25. The electron beam 22 originates at the electron gun 18, and the beam path is shown for reference. The beam follows a path from the gun 18 through the bend mechanism consisting of plates 19 and 20 and then terminates at screen 21, resulting in a visible display available to the observer. In the absence of any deflection of the electron beam, a spot of light at the center of the screen is produced. In order to move the spot of light in a manner suitable for generating a pictorial display, it is necessary to deflect the beam in both the horizontal and vertical directions while simultaneously varying its intensity, as is well known in the art. A first set of deflection coils 23, physically surrounding the outside of the tube, between the electron gun and the bender, causes the beam 22 to be deflected first in a plane normal to the plane of the drawing of Fig. 3 and coincident with the electron beam from the electron gun 18. Said deflected beam then passes through the entrance to the separation between plates 19 and 20. These plates are of sufficient width dimension so that the beam may pass through at any angle of deflection. Upon emerging from between said plates and after being bent around a parabolic shaped right angle path, the electron beam passes through a region where it is acted upon by the vertical deflection coils 24. The effect of both deflection systems is to produce a visible raster on the fluorescent screen. The intensity of the light produced at any and all points on this raster is effected by the cathode and grid elements within the electron gun.

The high voltage electrode 25 consists of a conductive film coating on the inside of the cone and provides a field-free region in which the beam may approach the screen in substantially straight line paths upon emerging from the vertical deflection region. This electrode is provided with the required high voltage or highest electron accelerating potential through the connector 26. The electrode is connected to the beam focusing electron lens electrodes within the electron gun and also to the attractor plate 19. All of these connections are made internally within the tube. Since the attractor plate 19 operates at the same high voltage as the other two elements, an additional attractor plate power supply is not required. The reflector plate 20 is operated at ground or cathode potential of the electron gun thus eliminating another power supply. However, if electrical centering of the raster is desired, the reflector voltage may be made variable. Since the reflector does not intercept the beam, it requires zero current to operate. Thus it may be supplied from a high resistance potentiometer connected across the the main high voltage supply without causing an unnecessary load on the supply.

Figure 4:
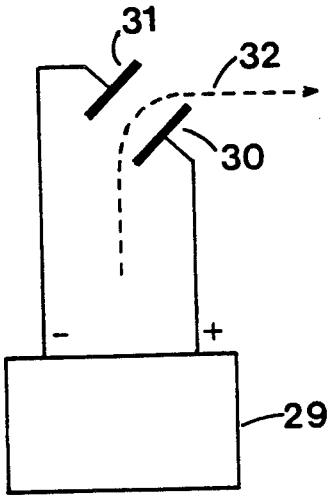
FIG. 4 is a schematic view, partly in block form, of the basic electrostatic beam bender.

The operation of the bender mechanism, incorporating the electrostatic attractor and reflector plates 19 and 20, may be understood by referring to FIG. 4. The attractor plate 30 and reflector plate 31 are shown connected to the voltage supply 29. The electron beam path 32 enters the bend mechanism from below and exits on the right hand side. A high electric field gradient exists between the plates due to the applied high voltage and the relatively close spacing of the plates. This electric field acts upon the electronic charge of the electrons comprising the electron beam to provide a force that accelerates the mass of the electrons in the direction of the increasing field gradient. By making the reflector plate negative and the attractor plate positive the direction of the force is toward the attractor plate. As the electron beam enters the region between the plates, the component of the entry velocity in a direction normal to the plates is reduced to zero before the beam can strike the reflector plate. Subsequently, the electrons are accelerated in the opposite direction, toward the attractor plate. At the same time the component of the entry velocity in a direction parallel to the plates remains unchanged since there is no field gradient operating in that direction. The vector sum of the beam's velocity in a direction parallel to the plates and the velocity imparted by the electrostatic force acting in the direction of the attractor plate results in an exit velocity from between the plates, that is the same as the entrance velocity with a direction out of the right hand side of the electrostatic bender. It is important to note that no portion of the beam is intercepted by either plate. Therefore, the total beam current exiting the electron gun is effective in producing luminance on the fluorescent screen after having passed through the bender. Thus, the bender mechanism provides a desirable 100% transmission. In addition, since none of the electron current is intercepted by the bender it provides a zero current load on the high voltage power supply, thus, it operates without absorbing electrical energy. As a result no heating occurs in the bender mechanism.

The description given heretofore was concerned with an undeflected electron beam passing through the bender mechanism. The following description covers the case where the beam is both deflected, by the first deflection action, and also bent, by the bender mechanism.

Figure 5:
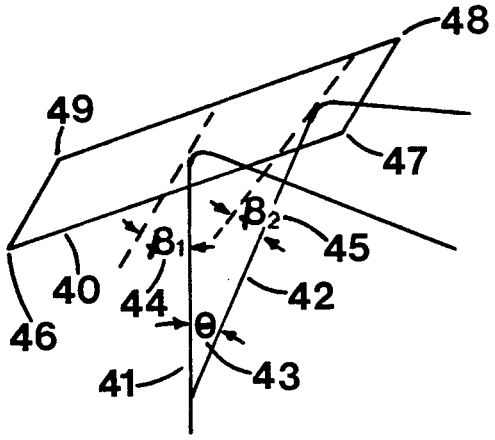
FIG. 5 is a graphical representation of the paths of the electron beam undergoing bending and horizontal deflection.

FIG. 5 is a graphical representation of the beam paths for both an undeflected and deflected beam relative to an imaginary plane that is parallel to and lies between the bender plates. The significance of this diagram is that it shows how the angle of incidence of the beam relative to the bender varies with the angle of deflection. As a result of the change in angle of incidence, the vertical position of the beam is displaced downward on each side of the horizontal center position. This action produces a curved trace on the fluorescent screen rather than the desired straight line. Methods for correcting this deficiency will be disclosed hereinafter. In FIG. 5 the imaginary plane 40 is defined by straight lines intersecting at the corners marked 46, 47, 48, and 49. This imaginary plane is parallel with both the reflector and attractor plates and passes approximately midway between them. As such it will serve to define the angles of incidence that exist between the various positions of the electron beam and the bender mechanism itself. Two electron beam paths are shown where 41 is the undeflected path and 42 is the deflected path. The angle of deflection ($\theta$) 43 is typical of any angle of deflection up to a maximum value on each side of the undeflected beam. The angle of incidence is defined as the angle that the approaching beam makes with a line normal to the plane 40. The angles of incidence of the two cases depicted are not shown but their angle complements are since they clarify the description. Typically, angle complement ($\beta_1$) 44 shows the angle that the electron beam makes relative to the bender mechanism in the undeflected case. Similarly, angle complement ($\beta_2$) 45 represents the deflected beam case.

The relation between the corresponding angle complements and the deflection angle $\theta$ is given by the following equation:

$$\beta = \arc\sin\left[\frac{1}{\sqrt{2(1+\tan^2\theta)}}\right] \quad (1)$$

The distance D that the beam travels along an imaginary plane that coincides with the attractor plate from the point of entry into the plane to the point of exit from the plane is given $$D=2\times S\times\sin 2(90^\circ-\beta) \quad (1)$$

by the following equation:

where S is the physical spacing dimension between the reflector and attractor plates.

The maximum distance D occurs when $\beta=45^\circ$ and becomes smaller for values of $\beta$ either larger or smaller than 45°. The above two equations (1) and (2) are combined to give the distance D as a function of the deflection angle as follows:

$$D = 2\times S\times\sin 2\left\{90^\circ - \arc\sin\left[\frac{1}{\sqrt{2(1+\tan^2\theta)}}\right]\right\} \quad (3)$$

Since sin 2 (90+)=0:

$$D = 2\times S\times\sin 2\left\{\arc\sin\left[\frac{1}{\sqrt{2(1+\tan^2\theta)}}\right]\right\}$$

Further analysis of the above equation (3) shows that D changes minimally for changes in $\theta$, where $\theta$ has an initial value of zero corresponding to $\beta_1=45^\circ$. For this reason it is desirable to let $B_1$ of the undeflected beam be 45°. Thus, both the reflector and attractor plates are set at a 45° angle relative to the undeflected beam. As the beam is deflected, $\theta$ increases while $\beta$ decreases so that the distance D decreases. Typically for a plate spacing of 0.25 inches, when $\theta=0°$ then $\beta=45°$ and D=0.50 inches and when $\theta=45°$ ( an extreme deflection ) then $\beta=30°$ and D=0.433 inches. The resultant trace on the fluorescent screen is a curved line whose highest point occurs in the center of the screen and then curves downward on each side.

There are a number of ways to correct the trace curvature that occurs in the bender mechanism. The most straightforward way for providing the correction is by shaping the reflector and attractor plates to match the various path lengths of the electron beam as it travels through the bender mechanism.

Figure 6:
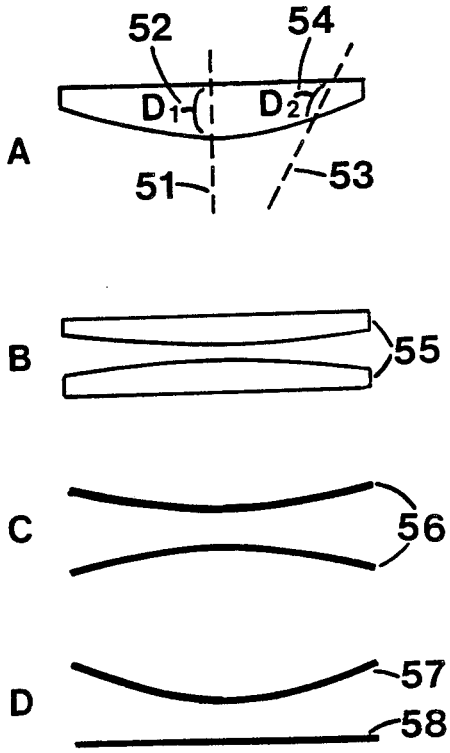
FIG. 6 A–D shows the shape of four forms of the modified electrostatic bender plates that eliminate trace curvature.

In FIG. 6 there are shown four different plate shapes that provide the necessary correction. The first plate shape 6 A utilizes a plate with a curved side on its beam entry and a straight side on its beam exit side. Dotted line 51 shows the undeflected beam path while 53 shows the deflected beam path in relation to the width of the bender plates. The distance D1 that the undeflected beam travels along 51, through the bender mechanism, is the same as the length 52 of the plates at their center. Similarly, the distance D2 that the deflected beam travels along 53 through the bender mechanism is the same as the angular length 54 of the bender plates. The correct curve of the plates is obtained by calculating a series of closely spaced distances through the plates at various deflection angles.

As the curved reflector and attractor plates are positioned at a 45° angle relative to the plane in which various angles of the beam leaving the first deflection region are positioned, there is a mismatch between the plane and the curved entry of the bender. This is corrected by bending the plane to match the entry curve, and is implemented with appropriate external magnetic components. For example, small deflection coils are positioned around the outside of the tube at the entrance to the bender mechanism. These coils are energized by parabolic shaped current waveforms derived from the horizontal sweep circuit. In a more simple manner, small permanent magnets attached to the outside of the tube near the bend region produce similar results.

A second plate shape is shown in B in FIG. 6B that eliminates the need for external compensation magnets. Each plate comprises two plates 55 which are similar in operation to those previously described. However, the entry side of the plates as well as the exit side are straight. The beam traversing distances through these plates, at any deflection angle, are the same as with plates 6A. The variable path length is achieved by curvature of the adjacent sides of the split plates where each curve has half the amplitude of the curve given to plate 6A.

A third plate configuration is shown in FIG. 6C where the plates 56 are straight on each side and their edges parallel but are bowed inward toward each other at their centers thus are most separated at their ends. FIG. 6 C shows only a front view of these plates to disclose the bowing. From the equation previously given for the distance that the beam travels through the bender mechanism, it may be observed that this distance is proportional to the spacing between the plates. By bringing the plates close together at their centers, where the distance is normally the largest, this maximum distance may be made equal to the distance traversed for the extreme deflection angles. With proper shaping of the bowing profile the distances through the plates at all deflection angles can be made equal. FIG. 6 D shows a top view of another configuration of the plates where a curved reflector plate 57 is used with a straight attractor plate 58. By allowing the plate spacing to increase on each side of the center of the widths of the plates, the distance that the beam traverses through the bender mechanism is increased in proportion to the spacing away from the center of the bender mechanism. This increased distance compensates for the loss in distance as a result of the prior first deflection. This configuration of plates represents the preferred embodiment because of its compatibility with the first deflection. All of the beam paths leaving the first deflection lie in a plane. By the use of an attractor plate that is flat and has edges that are straight and parallel to each other, this plane is parallel with the straight edge of the attractor plate. Thus, all the deflected beam paths pass through the bender in a uniform manner. The operation of these plates is similar to those as shown in FIG. 6 C. In addition to the four plate forms described herein, other configurations are available that will provide a similar function.

From the previous equation that describes the distance that the electron beam travels through the bender mechanism, it is observed that the distance D is independent of any operating voltages. Thus, changes in the high voltage applied to the bender plates have no effect on the vertical position of the visible trace on the fluorescent screen. As an example of the significance of this effect, a television receiver employing the cathode ray tube of this invention that undergoes a sudden change in line supply voltage would exhibit a stable picture without any erratic vertical shifting of the image.

Parallel electrostatic plates are electrically longer than their physical length due to fringing of the electrostatic field beyond the ends of the plates. Therefore, the physical length of the plates are made narrower than their electrical length. The plate lengths, of necessity, must be shorter than the dimension D otherwise the electron beam could strike the attractor plate either upon entering or upon leaving the bender mechanism. The design of parallel electrostatic plates is well known in the art.

Figure 7:
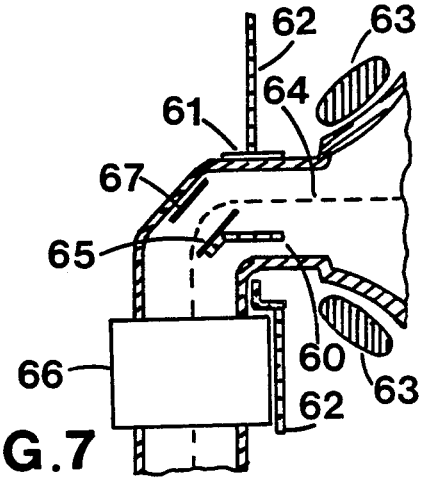
FIG. 7 shows the magnetic shielding in relation to the tube elements.

A magnetic shield is required between the electrostatic bender mechanism and the vertical deflection coils in order to eliminate a form of distortion in the displayed image. The most effective shielding is produced by a tunnel like shield assembly, close to and in front of the bender mechanism, in combination with a flat plate shield. As shown in FIG. 7, a portion of the tunnel shield 60 is physically mounted onto the attractor plate 65 internal to the tube, while a second part of the tunnel shield 61 is mounted above the internal shield 60 on the outside of the tube envelope. Additional shielding may be obtained by fabricating both the reflector plate 67 and the attractor plate 65 from the same magnetic shield material as the internal shield 60. The flat plate shield 62 surrounds the envelope and is spaced sufficiently behind the vertical deflection coils 63 so as not to shunt out the deflecting field that penetrates into the vertical deflection region 64. The horizontal deflection coils 66 surround the first deflection region immediately behind the shield 62.

Figure 8:
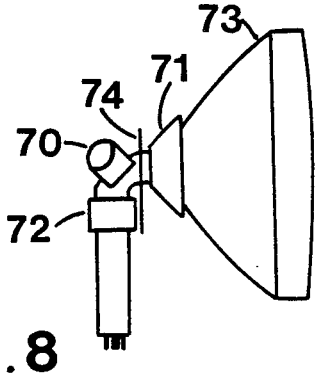
FIG. 8 Shows a tube utilizing a magnetic bender.

The bender mechanism may also be a magnetic device as shown in FIG. 8 where the shape of the glass envelope 73 is similar to that used in the electrostatic tube. Also similar are the placements of the horizontal deflection coils 72, the vertical deflection coils 71, and the magnetic shield 74. A magnetic field is set up by the bender magnet 70 that penetrates the bender region. The direction of the field is such as to bend the beam in the direction of the screen. The magnet may be either a permanent magnet or an electromagnet. In either case the beam is deflected in a circular path by the magnetic field with the same action as performed in the magnetic deflection regions. The trace curvature distortion is not present using the magnetic bender as it was using the electrostatic bender. The advantage of the magnetic bender over the electrostatic bender is a simplification of the internal structure of the tube and the ease of alignment of the electron path by positioning of the magnet. However, with a magnetic bender the bend angle is dependent on the high voltage applied to the tube. Thus, changes in high voltage applied to the tube affect the vertical position of the display. This can be overcome by providing circuitry that senses the high voltage and adjusts the current through the bender coils in an appropriate manner. If a permanent magnet bender is used it may contain a small surrounding coil to effect only vertical position correction. The problem may also be solved by use of a well regulated high voltage supply.

Figure 9:
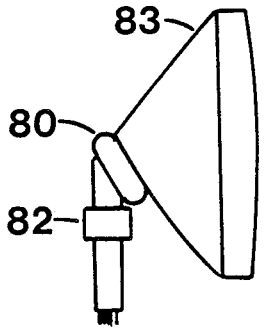
FIG. 9 shows a tube utilizing a combined magnetic bender and vertical deflection assembly.

A simplification of the magnetic bender and the vertical deflection coils is obtained by combining them into a single unit as shown in FIG. 9. For this configuration the glass envelope 83 is slightly shorter than that used with the separate bender and vertical deflection coils, as previously described, because the space between the bender and the vertical coils has been eliminated. The horizontal deflection coils 82 are in the same location as in all previous cases, while the magnetic shield is no longer required. The combination bender and vertical deflection coils 80 surrounds the bender portion of the envelope.

In the absence of current flow through both deflection coils, horizontal and vertical, the luminous spot remains stationary in the center if the screen. As the alternating current applied to the said vertical coils goes through one polarity, the resulting magnetic field produced by the coils opposes the field produced by the permanent magnet. This causes the electron beam to be bent at successive angles of less than 90° with a consequent movement of the luminous spot up to the top of the screen. Conversely, a reversal of polarity of deflection current causes the two magnetic fields to add together moving the spot to the bottom of the screen. When this action is coupled with horizontal deflection by current flow through horizontal coil 82, a display raster is produced on the screen.

Figure 10:
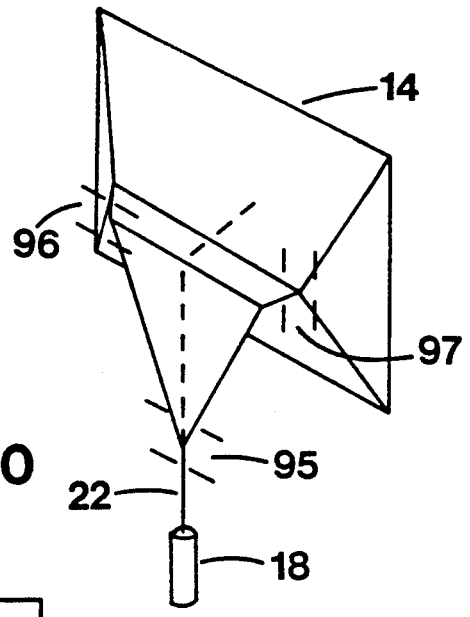
FIG. 10 shows the paths of the electron beam undergoing double deflection along the horizontal deflection plane.

The complete electron paths resulting from the deflection and bending operations are shown in FIG. 10. The electron beam 22 originates in the electron gun 18. It then enters the first deflection region 95 where it is deflected in a symmetrical manner about it's initial path. This first deflection corresponds to the horizontal deflection in the display raster. Subsequently, all of the beam paths leaving the first deflection region then pass through the bender region 96. As a result, the beam paths, that previously were parallel with the screen, are redirected so that they approach the screen in an orthogonal manner. The beam paths then pass through the second deflection region 97, wherein, the vertical deflection is produced. All of the beam paths terminate at the fluorescent screen 14, resulting in the production of a visible display.

If double horizontal deflection is employed, as previously described, then the second horizontal deflection takes place also in the second deflection region 97.

The most important single element that supports all of the previously described configurations of the small length cathode ray tube is the form of the glass envelope that constitutes the tube's enclosure. If this envelope is compared to that of a conventional cathode ray tube, it exhibits a shorter length by a factor of approximately two. If compared to a flat cathode ray tube it exhibits a longer length. However, as the screen size for each tube increases, the subject tube does not grow unwieldy in either its height or width dimension as does the flat tube. The novelty of this envelope lies in the fact that its packaged volume is smaller than either the conventional or flat cathode ray tubes, particularly for the larger size tubes where demand is the greatest. Also of significance is the fact that this is achieved without an inordinate cost of support circuitry or overall complexity.

When used in color television applications the self-convergence feature may be applied to this tube just as is done in the conventional color tube. This is achieved by appropriate winding distributions in the horizontal and vertical deflection coils to achieve the required astigmatic deflection fields. Alternatively, a small magnetic convergence assembly may be placed between the gun and the first horizontal deflection coils to effect beam convergence. This assembly consists of two electromagnets positioned on the outside of the tube to act only on the two outer beams emanating from the guns. Their purpose is to spread the two outer beams away from the center beam as the three beams are deflected away from the center of the screen in both the horizontal and vertical directions.

The tube is also suitable for use in beam index color tube applications. This configuration would require a single gun, a multicolor screen with index stripes, and also a beam position reporting mechanism.

In the previous descriptions the first deflection region was normally associated with horizontal deflection, while the second deflection region was associated with vertical deflection. However, this was done as a matter of consistency in the descriptions. It is also appropriate for the roles of the two deflection regions to be reversed. The deciding factor would be based on the application.

Figure 12:
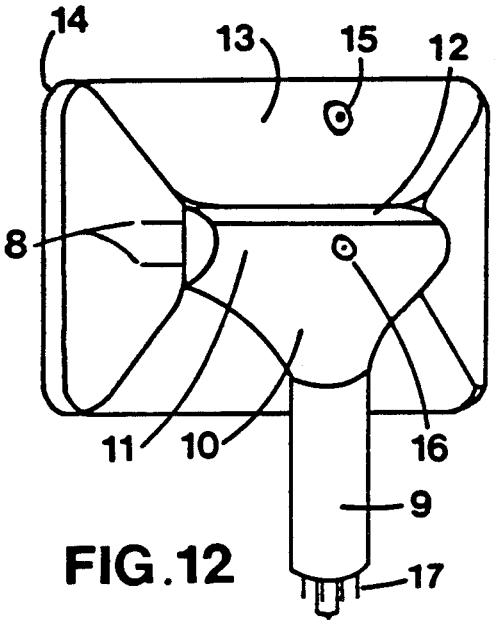
FIG. 12 is a side rear view of the envelope configuration of a second embodiment of the short cathode ray tube of the present invention.
Figure 13:
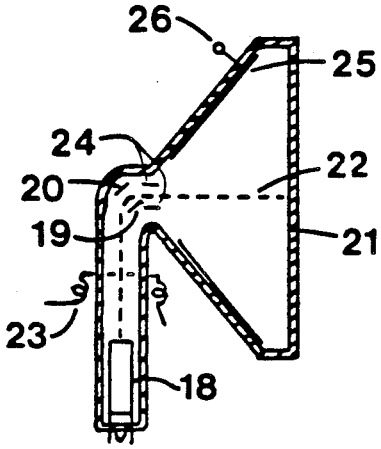
FIG. 13 is a cutaway side view of the tube, showing the electron beam path from the election gun, through the bend and vertical deflection region, and finally terminating on the screen for the second embodiment of FIG. 12.

In all of the previously described configurations, deflection was accomplished by magnetic means. While magnetic deflection is suitable for the first deflection, electrostatic deflection is preferred over magnetic deflection for the second deflection because the stray fields from a magnetic deflection coil interfere with the operation of the bender mechanism. If the deflection regions, previously energized by magnetic fields (see FIGS. 12 and 13), pairs of electrostatic deflection plates 27 with connection heads 7 attached thereto are inserted, alternatively the beam may be deflected electrostatically. While electrostatic deflection in the first deflection region is not as practical as in the second region due to the higher sweep rate as normally enocuntered in television and data display applications it is used to particularly good advantage in the second deflection region. Therefore, the following description of electrostatic deflection will be directed towards second or vertical deflection where sweep rates normally are low. The mode of operation of the electrostatic deflection is considerably different from that used in conventional electrostatically deflected cathode ray tubes. Conventional tubes use long deflection plates with relatively low deflection voltages that achieve small deflection angles. The subject tube uses very short deflection plates with very large deflection voltages to achieve large deflection angles. This mode of operation is based directly upon the operation of the beam bender, previously described.

It is observed that the large 90° bend achieved in the electrostatic bender may be considered to be a pair of 45° bends in each half of the bender mechanism. The bender mechanism halves exist symmetrically about an imaginary plane that bisects both plates at right angles along the width dimension halfway across the short length dimension. As the beam goes through the first 45° bend in the first half of the bender mechanism, it starts in to the second half of the bender mechanism with two significant characteristics. First, the beam is parallel to the bender plates, and second, the beam velocity has been reduced by a factor of 0.707. The action of the second half of the bender plates can be emulated with a pair of deflection plates having a length to spacing ratio of unity, since the maximum plate length to spacing ratio for the bender mechanism is two to one. Thus, the deflection plates are half as long as the bender plates. The deflection angle will be 45° if the incoming beam is parallel to the plates and has a velocity of 0.707 times the beam velocity entering the bender mechanism and the deflection voltage applied to the plates is the same as that applied to the bender plates. In normal operation the bender mechanism would precede the deflection plates relative to the direction of the electron beam. The beam velocity exiting the bender mechanism is the same as the entrance velocity, although the beam velocity was decreased and subsequently increased within the bender mechanism. The beam velocity exiting the bender mechanism is too large for the required entrance velocity of the deflection plates by a factor of $1/0.707=1.414$. The beam velocity may be reduced to the proper value by operating the deflection plates such that the average potential halfway between the plates is a steady value equal to one half of the voltage applied to the attractor plate in the bender mechanism. This is a very fortuitous operating condition because it can be readily achieved by supplying the deflection plates with balanced out of phase sawtooth voltages that vary between the limits of zero potential and the potential of the attractor plate. After the electron beam passes the electrostatic deflection region, the beam velocity is increased to equal the original velocity entering the bender mechanism. This velocity increase is effected by the final accelerating field set up by the second anode coating on the envelope located between the deflection plates and the screen.

Figure 11B:
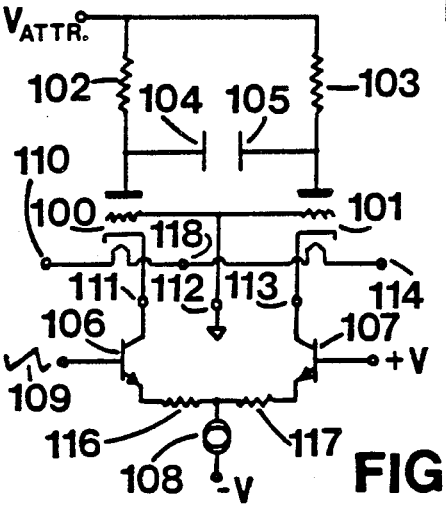
FIG. 11B is a schematic diagram of a deflection amplifier circuit of the present invention.
Figure 11A:
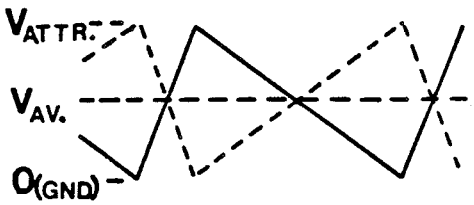
FIG. 11A shows graphically two deflection voltage waveforms of the present invention.
Figure 11C:
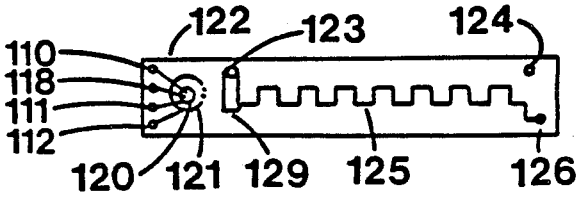
FIG. 11C shows a side view of ceramic strips on which the high voltage deflection circuit can be mounted for enclosure within the CRT of the present invention.
Figure 11D:
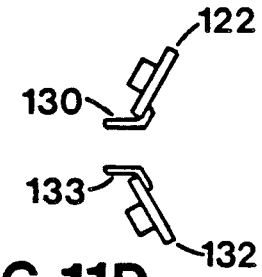
FIG. 11D shows the ceramic strips of FIG. 11C mounted to a second pair of deflection plates of the present invention.

The deflection voltages are shown in FIG. 11A in association with the circuit used for generating them. This deflection amplifier circuit of FIG. 11B uses high voltage, low current, high mu triodes in combination with a transistor differential current source. The triodes 100 and 101 operate in the grounded grid mode so that the current entering each cathode appears in the plate circuit. The resulting plate currents of triodes 100 and 101 develop the out of phase deflection voltages across the plate load resistors 102 and 103, respectively. These voltages are supplied to the deflection plates 104 and 105 (plates 27 of FIG. 13) by direct connection from the respective plate circuits. The transistor differential amplifier utilizing transistors 106 and 107 supply the proper sawtooth currents to the triodes 100 and 101, respectively. Transistor 106 receives a linear driving sawtooth at its base, while transistor 107 is supplied with a base bias voltage equal one half the peak voltage of the driving sawtooth. A current source 108 supplies a constant current to both transistors resulting in a condition that when the current through either transistor changes, the current through the other transistor changes in the opposite direction. Resistors 116 and 117 relative to resistors 102 and 103 determine the required voltage gain of the circuit, whereas the current supplied by current source 108 determines the average voltage at the deflection plates and, thus the entrance beam velocity. The circuit may be implemented with all discrete components or that portion of the circuit that includes the triodes, the load resistors, and the deflection plate connections may be integrated within the cathode ray tube. The high voltage circuit is fabricated on a ceramic strip that mounts directly on the deflection plates. A side view is shown in FIG. 11C where the ceramic strips 122 and 132 are fastened to the deflection plates 130 and 133 (plates 27 of FIG. 13 and plates 104 and 105 of FIG. 11B), respectively as shown in FIG. 11D. These assemblies are mounted in pairs within the cathode ray tube enclosure and the associated lead wires pass through the enclosure via a low voltage connector. The ceramic strip 122 contains plate load resistor 125 and the triode elements as follows: cathode 120, control grid 121, and plate 129. A connection is made from the triode plate to the associated deflection plate by the mounting rivet that passes through hole 123 while hole 124 is just for physical mounting. The grid completely surrounds the cathode to prevent stray emission to neighboring positive potential elements. The connections for the heater 110 and 118, the cathode 111, and the grid 112 are brought to the end of the strip for interconnection with the connector that passes through the enclosure. The high voltage terminal 126, that connects to the plate load resistor 125, connects inside of the cathode ray tube with the high voltage connector that also supplies the second anode coating as well as the attractor plate in the bender mechanism. There is no need to enclose each triode in a separate evacuated enclosure as the vacuum within the cathode ray tube provides the proper operating environment. Also, separate gettering of the triodes is eliminated as the common getter in the cathode ray tube suffices.

Triodes similar to the ones required in this invention were used in early color television receivers for the purpose of regulating the high voltage that operated the picture tubes. One important precaution taken with these triodes was to insure proper operating conditions so that the generation of X-rays by these tubes was minimized. By enclosing these triodes in the same envelope comprising the cathode ray tube the danger of X-ray radiation from these elements is further minimized. Since the cathode ray tube is fabricated from radiation attenuating glass, this same material provides protection around the triodes at no additional cost.

In order to maintain a small load on the high voltage supply for the tube, the amplifier plate load resistors must be very large, typically 50 Megohms. Even with small distributed capacitance in the plate circuit, the amplifier frequency response is low. Therefore, this type of circuit is limited to vertical deflections, typically 50 or 60 cycles, as found in television receivers. The integrated version of the high voltage amplifier is preferred over the external discrete component version because it has lower stray capacitance, thus better frequency response.

The potentials supplied to the deflection plates are alternating whereas the potentials supplied to the bender mechanism are steady. Thus, the deflection plates provide ±45° of deflection, whereas, the bender plates produce a fixed 90° beam bend. Where vertical deflection greater than ±45° is required, the length of the deflection plates may be extended. The shape of the plate then becomes important so that no portion of the beam is intercepted by the plates. This can be accomplished by bending the extended portion to lie outside of the beams path.

One inherent deflection distortion arises with the use of wide deflection plates having a small length. The beam paths between the plates become progessively as the beam is horizontally deflected away from the undeflected center position. The resulting display raster on the fluorescent screen shows straight vertical sides with pincushioning along the top and bottom edges. This adverse effect may be corrected in a manner similar to that used for correcting the bender curvature distortion. The deflection plates may be curved along their edges so that all paths through the plates are equal. Alternatively, the plates may be bowed in at their centers, thus increasing the deflection sensitivity in the region of the shortest paths.

These methods of compensation are particularly useful in color television applications. The necessary criterion for vertical self-convergence in an in-line three gun color cathode ray tube is a barrel shape vertical deflection field. This barrel shaped field may be readily obtained by overcompensation of the vertical deflection plates by either or a combination of the above given two methods. The criterion for horizontal self-convergence is a pincushion shaped horizontal deflection field. This also is readily achieved by the winding distribution of the horizontal deflection coils.

When elecrostatic vertical deflection, as previously described, is used with magnetic horizontal deflection, a rather ideal situation is created regarding the external circuitry. Magnetic horizontal deflection is usually associated with a fly-back high voltage supply which gives rise to overall circuit simplicity and economies. Electrostatic vertical deflection, using the integrated high voltage deflection amplifiers, is compatible with low power solid state circuitry that is universally in use today. It is also possible to use the combination elecromagnetic and electrostatic deflection with the accompanying vacuum tube amplifier in a conventional cathode ray tube. It is well known in conventional color cathode ray tube operation that the stray magnetic field from the vertical deflection coils can interact with the horizontal deflection field to degrade the convergence of the three beams in the tube. This degradation is known as trilemma effect, or the inability to resolve exactly the displacement of the three beams. In such an application the low fringing or leakage electrostatic field from the electrostatic deflection plates would minimize certain distortions such as trilemma effects in color tubes.

Horizontal deflection power is greatly reduced in the short tube as compared to the conventional tube. This is brought about by two salient factors. First, the horizontal deflection angle is smaller by a significant amount, and second, the one-dimensional deflection region under the horizontal deflection coils makes the glass envelope flatter bringing the coils close to the beam, thus increasing the deflection sensitivity. In addition, the horizontal deflection coil becomes smaller and less expensive to manufacture and also to replace.

The short cathode ray tube utilizing magnetic first deflection, an electrostatic bender, and electrostatic second deflection, besides permitting the use of a small and conveniently shaped equipment enclosure, provides a number of other advantages. Since the vertical deflection mechanism is built into the tube, the use of an external vertical deflection coil is eliminated. This factor saves time in production since there is no need to build or install the assembly on the tube. Since there are always variations in production lots of vertical deflection coils, additional small permanent magnets are required in order to straighten out the raster shape. Adjustment of the magnets requires additional manufacturing time and labor and, thus, increased manufacturing costs. Also, field service of the components is eliminated. The internal deflection plates that take the place of the deflection coils are stamped out of metal in a low cost process that inherently gives better production control than does coil winding of the vertical deflection coils. Also the glass enclosures that contain and support the plates are molded inexpensively to align the plates with the fluroescent screen.

In conventional color television receivers, it is standard practice to place the driving amplifiers for the electron gun on an auxillary circuit board that is mounted on the base of the tube. This arrangement preserves signal bandwidth that otherwise would be affected by long lead lengths. With the use of the short cathode ray tube the cost of this extra assembly can be eliminated because the gun portion of the tube is positioned directly over these same amplifiers replaced to the main circuit board, where interconnecting short lead lengths are acceptable.

A television receiver utilizing this tube will have a cabinet depth one half of the depth of a receiver using a conventional cathode ray tube. This means that the weight of the cabinet will be reduced by roughly one third and the volume will be reduced by one half. These factors have a considerable impact on the manufacturing inventory and shipping facilities and costs. Warehousing and shipping at the wholesale and retail level are similarly affected. Installation becomes an easier chore because of these same factors. Since all of these considerations translate into the price that the consumer pays for a television receiver, the end result is a decided bonus. In addition, the small cabinet size increases the flexibility of installation. The small depth allows a range of installations all the way from hanging on the wall like a shelf to coordination with narrow pieces of furniture such as bookshelves or assemblages of stereo components. Thus, the homeowner has far more options in furniture arrangements making the home environment more pleasurable and confortable. These receivers may also be custom installed in walls or closets without causing excessive bulges or protrusions. The reduction in power requirements for the receivers means less heat generated and thus greater safety from fire hazards in installations where air circulation has been impeded. Due to the smaller size and weight of the cabinets there is less effort for a service technician to pick up or deliver receivers where shop service is required.

In conclusion, the advent of a practical SHORT CATHODE RAY TUBE provides a number of advantages that extend far beyond those provided by conventional cathode ray tubes.

What is claimed is:

1. A short cathode ray tube comprising: an evacuated envelope formed with:

a first section having an electron beam source at one end for directing at least one electron beam along an initial path, wherein said electron beam source includes focusing electron lens means disposed to have a selected highest electron accelerating potential applied thereto, and a cathode;

a second section having a display screen, said display screen being substantially parallel to the initial path of said electron beam;

magnetic deflecting means in said first section for magnetically deflecting said electron beam in a beam plane generally parallel to the plane of the display screen;

non-defocusing electrostatic bending means for electrostatically bending said beam subsequent to said magnetic deflection to change the plane of said beam to a second plane substantially orthogonal to said beam plane wherein no defocusing of the beam occurs within the bending means, said electrostatic bending means comprising spaced conductive plates, including attractor plate means and reflector plate means with the attractor plate means disposed to have the highest electron accelerating potential applied thereto, each having a length dimension in the direction of the electron beam and a width dimension that is perpendicular to the length dimension, the length dimension being smaller than the width dimension; and electrostatic deflecting means for deflecting said electron beam subsequent to said bending means in a direction that is substantially orthogonal to the said second plane.

2. A short cathode ray tube as in claim 1 in which said attractor plate means and said reflector plate means comprises first and second spaced rectangular conducting plates of substantially similar size with the spacing between said plates being closest at the center of their widths and progressively further separated from the center outwardly to the ends.

3. A short cathode ray tube as in claim 2 wherein said first plate is substantially flat and said second plate is convex only in its width dimension relative to the first plate so that a plane that passes through the four corners of the convex plate is parallel to the first plate.

4. A short cathode ray tube as in claim 3 wherein said first plate is disposed to be electrically connected to the highest electron accelerating potential in the tube.

5. A short cathode ray tube as in claim 1 wherein the electrostatic means for electrostatically deflecting the electron beam comprises spaced deflection plates.

6. A short cathode ray tube as in claim 1 wherein said electrostatic means comprises deflection plates, said deflection plates having a length dimension in the direction of the electron beam path and a width dimension that is perpendicular to the length dimension and at least one of said deflection plates is bent along its width direction so that the plates are closest at the center.

7. A short cathode ray tube as in claim 1 wherein said electrostatic means comprises deflection plates, said deflection plates having a length dimension in the direction of the electron beam path and a width dimension that is perpendicular to the length dimension said length dimension decreasing away from the center in both directions.

8. A short cathode ray tube as in claim 1, wherein alternating voltages are supplied to said deflecting means and steady D.C. voltages are supplied to said bending means.

* * * * *